US007210560B2

(12) United States Patent
Brink

(10) Patent No.: US 7,210,560 B2
(45) Date of Patent: May 1, 2007

(54) FOLDING PLATFORM STRUCTURE

(76) Inventor: Daniel J. Brink, 2311 St. Charles, Quincy, IL (US) 62305

( * ) Notice: Subject to any disclaimer, the term of this patent is extended or adjusted under 35 U.S.C. 154(b) by 309 days.

(21) Appl. No.: 10/828,931

(22) Filed: Apr. 21, 2004

(65) Prior Publication Data

US 2005/0225044 A1 Oct. 13, 2005

Related U.S. Application Data

(63) Continuation-in-part of application No. 10/811,072, filed on Mar. 26, 2004, now abandoned.

(51) Int. Cl.
*E04H 15/34* (2006.01)

(52) U.S. Cl. ..... 182/222; 182/223; 182/20; 135/95

(58) Field of Classification Search ..... 182/222, 182/119, 223, 152, 153, 224, 225, 28, 33, 182/35, 20, 116; 135/90–99, 121–126, 128, 135/115, 15.1, 900, 901; 108/50.12, 12, 108/166, 171, 14, 18
See application file for complete search history.

(56) References Cited

U.S. PATENT DOCUMENTS 2,452,169 A * 10/1948 Wells ..... 297/158.4
2,549,242 A * 4/1951 Ross ..... 108/15
2,668,331 A * 2/1954 Horn ..... 108/171
2,960,992 A * 11/1960 Klipfel ..... 135/136
4,830,036 A * 5/1989 Sanders ..... 135/88.17
4,951,781 A * 8/1990 Bliss ..... 182/152
5,013,085 A * 5/1991 Craig ..... 297/184.15
6,035,875 A * 3/2000 Chen ..... 135/88.07
6,061,970 A * 5/2000 Fujita ..... 52/7
6,637,349 B1 * 10/2003 Lafferty ..... 108/20

FOREIGN PATENT DOCUMENTS

FR 372284 * 6/1990

* cited by examiner

*Primary Examiner*—Hugh B. Thompson, II
*Assistant Examiner*—Colleen M. Quinn
(74) *Attorney, Agent, or Firm*—Rossi, Kimms & McDowell, LLP

(57) ABSTRACT

A platform structure has at least two articulated platforms that can extend end-to-end to form a bench type arrangement. For ease of portability, the structure includes wheels so that it can be carted when it is in a stow position. The structure can include a detachable canopy frame and a canopy, which provides protection from the element, namely rain, snow, sun, and wind. The canopy can have a camouflaged pattern so that it can blend into the surrounding. When the canopy is camouflaged, the structure is instantly converted into a hunting blind. In addition, a mounting mechanism is provided to mount the platform structure to another structure.

8 Claims, 23 Drawing Sheets

Fig. 2A
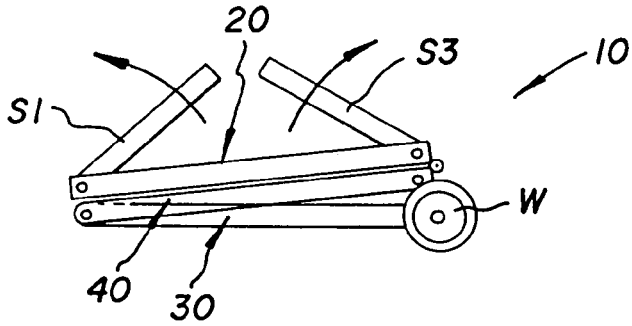
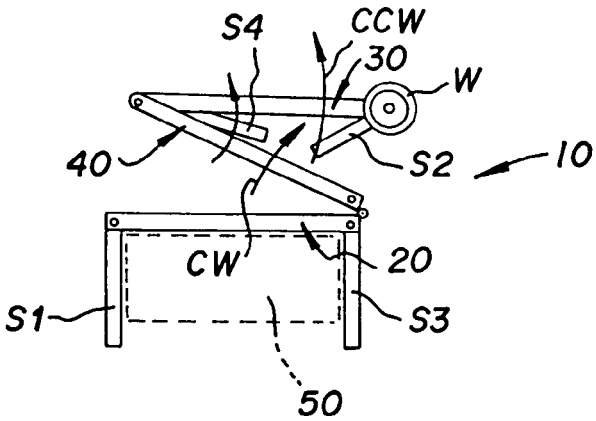
Fig. 2B
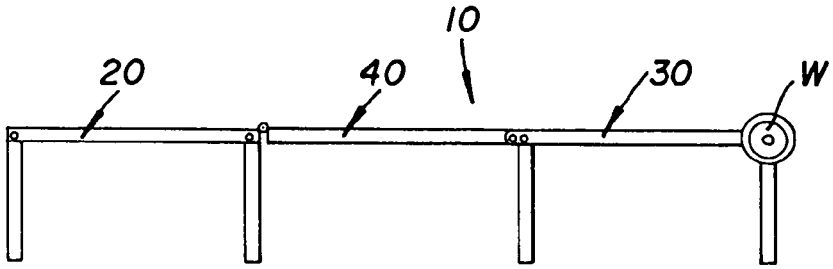
Fig. 2C

FOLDING PLATFORM STRUCTURE

CROSS-REFERENCE TO RELATED APPLICATION

This application is a continuation-in-part application of and claims priority from U.S. application Ser. No. 10/811,072 entitled "Portable Platform Structure" filed on Mar. 26, 2004 now abandoned, the contents of which are incorporated herein by reference.

BACKGROUND

The present invention is directed to providing a folding platform structure. In particular, the present invention is directed to providing a seat, table or bar structure that can be easily transported by an individual to a site of use and/or attached to a fixed structure.

There are a number of situations in which an individual may desire to have a portable seating, table or bar structure. U.S. Pat. No. 5,810,430, for example, describes a need for portable seating apparatus in spectator situations. Newer spectator arenas are designed to maximize the use of valuable space. An anchored seating arrangement, such as fixed benches, cannot be easily configured based on the type of event taking place at the arena. Accordingly, some form of portable structure is preferable. Similarly, in many outdoor events, it is desirable to providing as seating and/or table structure. For example, in many open field events for non-professional sports activities, no seating structures exist. Particularly in the case of soccer fields, coaches and players are often left standing and exposed to the elements. There still remains a need for a seating structure that can be easily setup/stowed at locations where no or limited seating space is available and further to provide cover from the weather. Still other examples include hunters that need seating and cover for hunting blinds or individuals participating in tail gate parties at sporting events in needs of seating and tables. Still further, a folding platform structure that could be utilized in conjunction with a fixed structure would be desirable in situations in which inclement weather may overturn a seat, table or bar.

In view of the above, it would be desirable to provide a seat, table or bar structure can be folded into a compact storing position, that can be made portable for easy transportation, that can provide cover from the elements of weather, and that can alternatively be coupled to a fixed structure.

SUMMARY OF THE INVENTION

The present invention provides a seat, table or bar structure that can be folded into a compact storing position, that can be made portable for easy transportation, that can provide cover from the elements of weather, and that can alternatively be coupled to a fixed structure.

In one aspect of the invention, a structure is provided that has at least two articulated platforms, a plurality of supports articulated to the platforms. The platforms can be articulated so that the platforms are movable between an extended position where the platforms extend substantially in an end-to-end configuration, and a stow position where the platforms are folded so that the platforms are substantially aligned one above another. The supports can be articulated to the platforms. One or more wheels can also be rotatably mounted to one of the platforms.

Each of the platforms can be substantially planar, and the adjacent platforms can be articulated with each other for a pivotable movement of about 180°. Specifically, the platforms can comprise a first end platform, at least one intermediate platform, and a second end platform. One end of the first end platform can be articulated to one end of the intermediate platform, and the other end of the intermediate platform can be articulated to one end of the second end platform. The intermediate platform can be pivotable substantially about 180° relative to the first end platform in a first rotational direction from the stowed position to the extended position, and the second end platform can be pivotable substantially about 180° relative to the intermediate platform in a second rotational direction from the stowed position to the extended position. The second rotational direction is opposite to the first rotational direction. A pair of wheels can be rotatably mounted to the other (outer) end of the second end platform.

The supports can include a first support can be foldably articulated to an outer end portion of the first end platform, a second support can be foldably articulated to an outer end portion of the second platform, and third and fourth supports can be foldably articulated to intermediate portions of the articulated platforms between the first and second supports. The first support can be pivotable substantially about 90° relative to the other (outer) end of the first end platform, the third support can be pivotable substantially about 90° relative to one of the articulated ends of the first end platform and the intermediate platform, the fourth support can be pivotable substantially about 90° relative to one of the articulated ends of the intermediate platform and the second end platform, and the second support can be pivotable substantially about 90° relative to the other end of the second end platform.

The structure can include a first elongated support brace detachably mountable to the first support and a second elongated support brace detachably mountable to the second support to stabilize the structure, i.e., prevent from tipping.

The structure can include a handle, which can comprise a first elongated hole formed through the first end platform and a second elongated hole formed through the intermediate platform. The first and second elongated holes can be respectively positioned adjacent to the other end of the first end platform and adjacent to the articulated ends of the intermediate platform and the second end platform so that when the platforms are in the stow position, the first and second elongated holes align with each other.

The structure can further include a canopy frame detachably mountable to the platforms and the first, second, third, and fourth supports, and a canopy detachably mountable to the canopy frame. The canopy can have a camouflaged pattern to form a hunting blind. The canopy frame can comprise a pair of first poles detachably mountable to the first end platform, a pair of second poles detachably mountable to the second end platform, a third pole detachably mountable to one of the articulated ends of the first end platform and the intermediate platform, and a fourth pole detachably mountable to one of the articulated ends of the second end platform and the intermediate platform.

The outer end of each of the first and second end platforms can have a pair of holes for passage of the respective pair of first and second poles, and the one end of the first end platform can have an opening for passage of the third pole, and the other end of the intermediate platform can have an opening for passage of the fourth pole. The first, second, third, and fourth supports each can have an opening for receiving one of the pairs of first and second poles or one of the third and fourth poles, respectively. The first and second support braces each can have an opening for receiving one of the pair of first and second poles, respectively.

The structure can include at least one storage compartment detachably mountable to one side of the first and third supports. The storage compartment can be configured to store at least one of the canopy frame and the support braces.

Another aspect of the present invention is a hunting blind formed by the structure described above with a camouflaged canopy.

In a still further aspect of the invention, a mechanism is provided to attach the structure to another fixed structure.

BRIEF DESCRIPTION OF THE DRAWINGS

These and other features, aspects, and advantages of the present invention will become more apparent from the following description, appended claims, and an accompanying exemplary embodiment shown in the drawings, wherein:

FIGS. 2A–2C schematically illustrate how the seating structure of FIG. 1 is set up for use (stowing sequence being reverse);

DETAILED DESCRIPTION OF THE PREFERRED EMBODIMENTS OF THE INVENTION

FIGS. 1–10B serve to illustrate one exemplary embodiment according to the present invention. Although references are made herein to directions in describing the present structure, they are made relative to the drawings (as normally viewed) for convenience. The directions, such as left, right, top, etc., are not intended to be taken literally or limit the present invention in any form. Further, an example of the invention will be described with reference to a seating structure, however, the invention is not limited to seating structures but is also applicable to table structures, bar structures or other platform structures.

Figure 3:
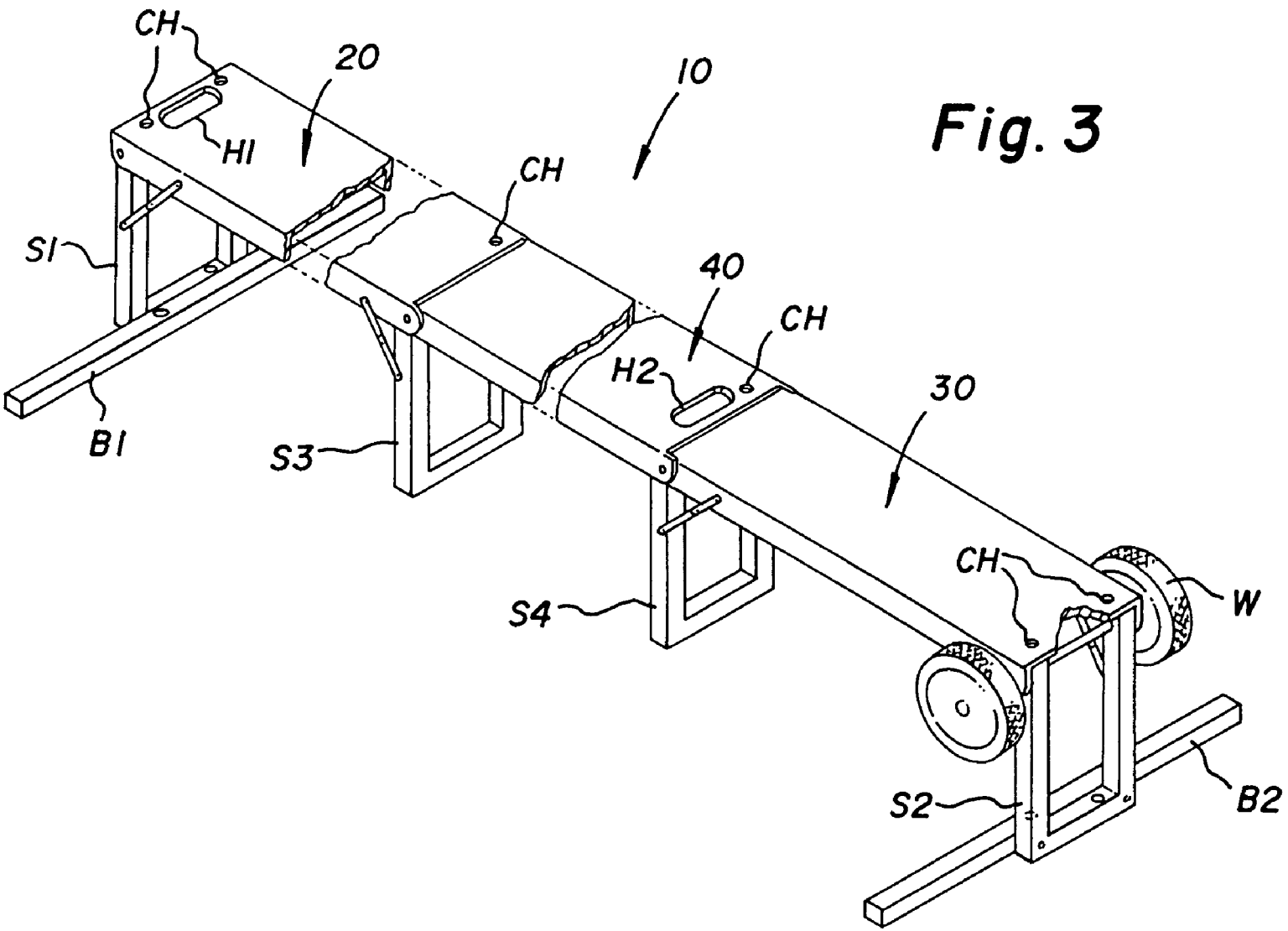
FIG. 3 illustrates a perspective view of the seating structure of FIG. 1 when it is set up for use.

The present portable seating structure 10 can be made compact when it is folded, in the ready-for-transport configuration (FIG. 1), yet it can be easily set up for seating many people (FIG. 3). The present seating structure 10 comprises at least two articulately linked seating platforms P, and a plurality of base supports S for supporting the seating platforms above the floor/ground, and at least one wheel W rotatably mounted to one of the seating platforms.

Figure 1:
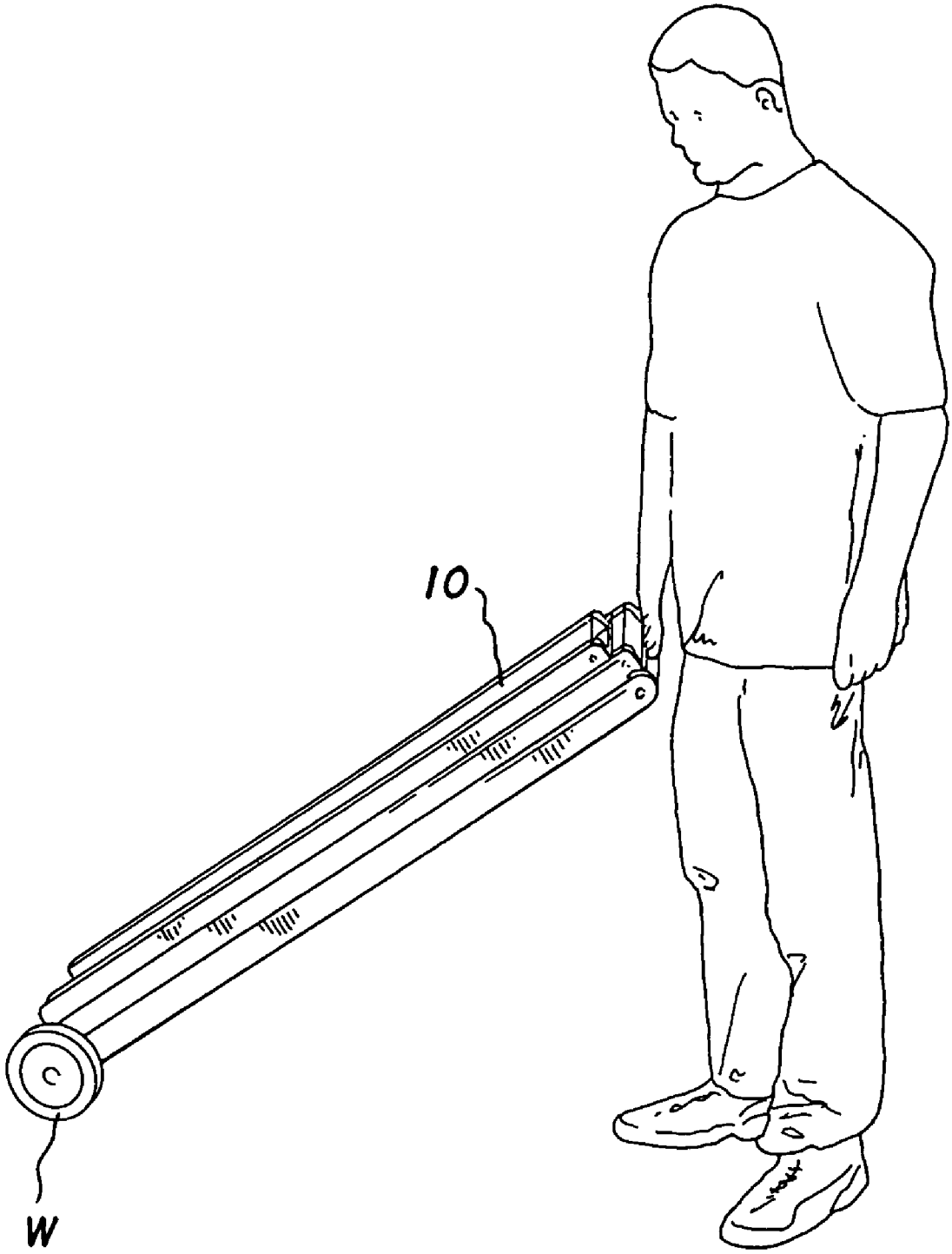
FIG. 1 illustrates a perspective view of a portable seating structure according to the present invention in a stowed, mobile position.

In the exemplary embodiment, the seating structure 10 has three articulated seating platforms P, namely a first end seating platform 20, a second end seating platform 30, and an intermediate seating platform 40, that can be positioned between an extended configuration where the articulated seating platforms extend substantially collinearly or in an end-to-end configuration (FIG. 3), and a stow position where the articulated seating platforms are folded so that the seating platforms are substantially aligned one on top of another (FIG. 1).

For example, each of the seating platforms 20, 30, 40 can be made about four feet long, resulting in a seating structure (bench type) that is about 12 feet long. That is sufficient to seat 6–10 people, and yet when it is folded, it is only about 4 feet long, making is easily portable. Of course, additional seating platforms can be chained together to create a longer seating structure to accommodate more people as desired. Alternatively, the length of the platforms may be varied as desired.

Figure 7A:
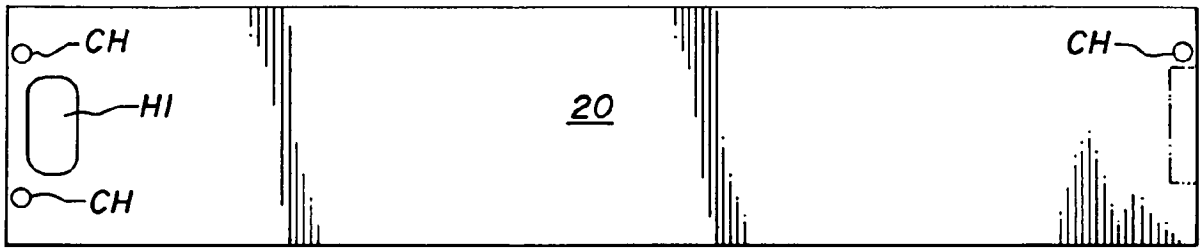
FIGS. 7A–7C respectively illustrate top, front, and left-end views of a left or first end seating platform.
Figure 7B:
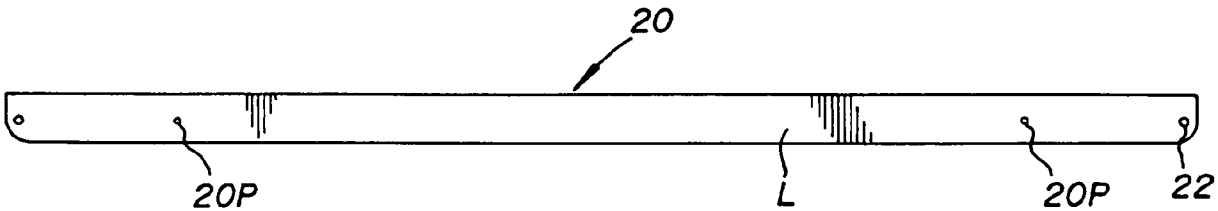
Figure 7C:
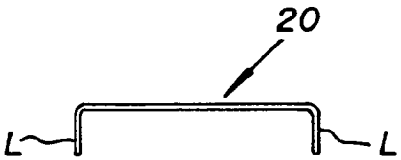
Figure 8A:
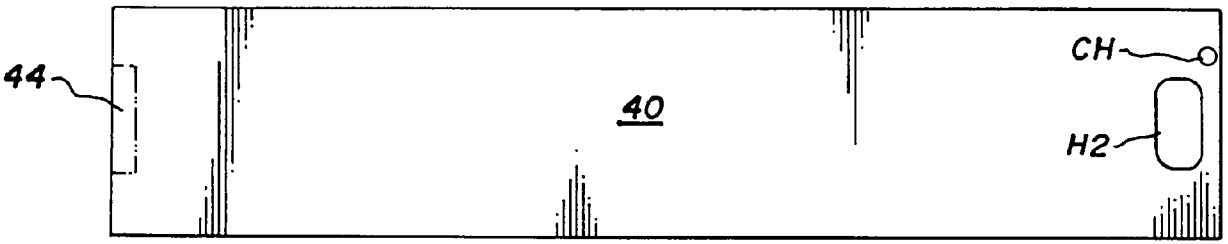
FIGS. 8A–8C respectively illustrate top, front, and left-end views of an intermediate seating platform.
Figure 8B:
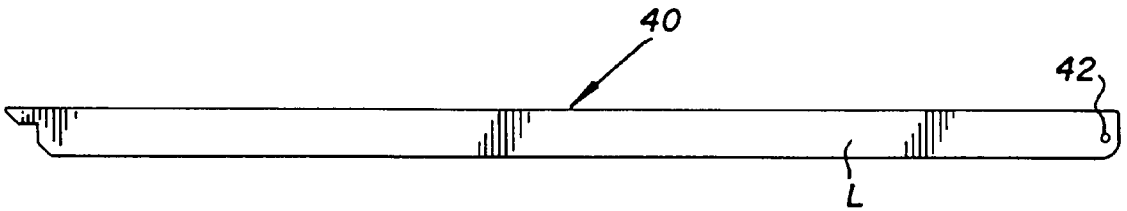
Figure 8C:
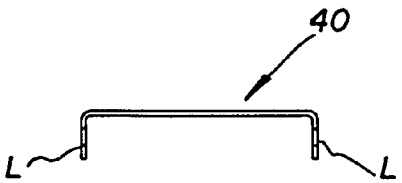
Figure 9A:
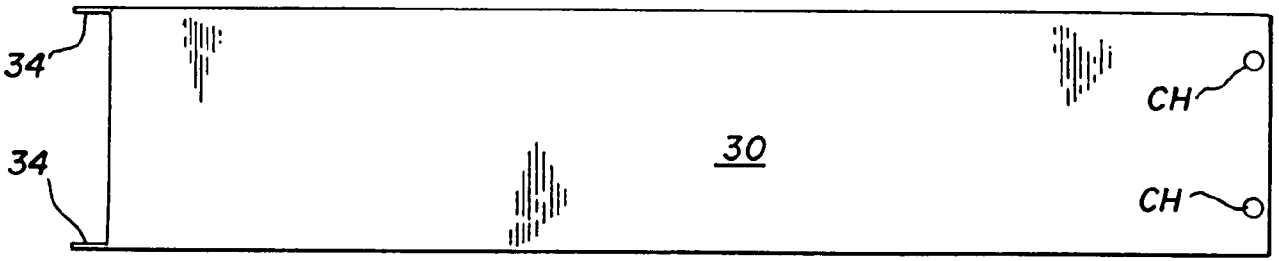
FIGS. 9A–9C respectively illustrate top, front, and left-end views of a right or second end seating platform.
Figure 9B:
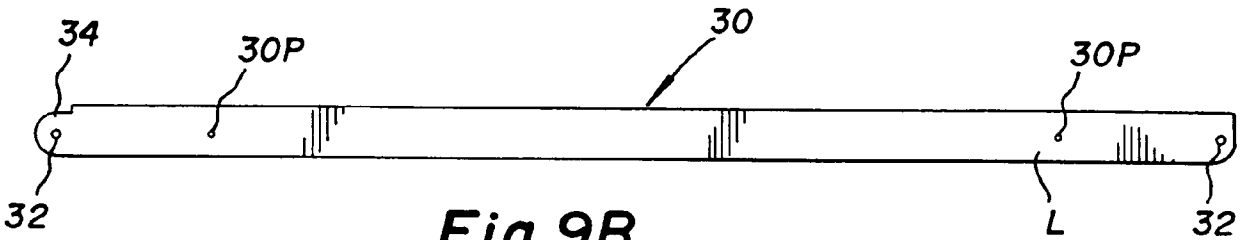
Figure 9C:
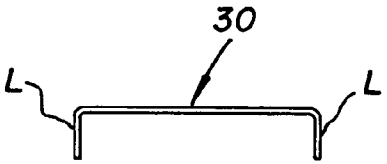
Figure 10B:
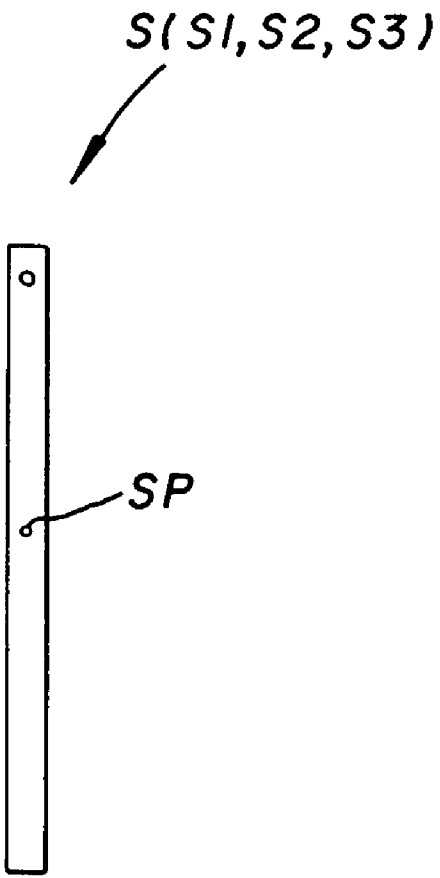
FIGS. 10A and 10B illustrate detailed structure of a base support for the seating platforms.
Figure 10A:
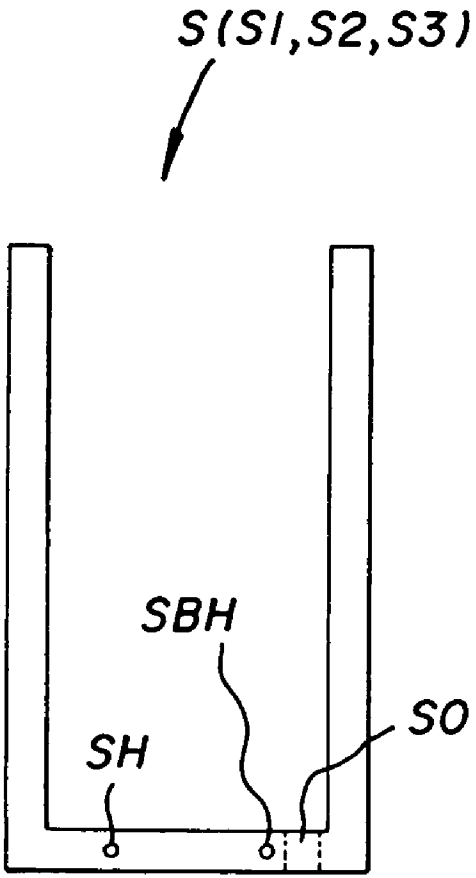
Figure 11:
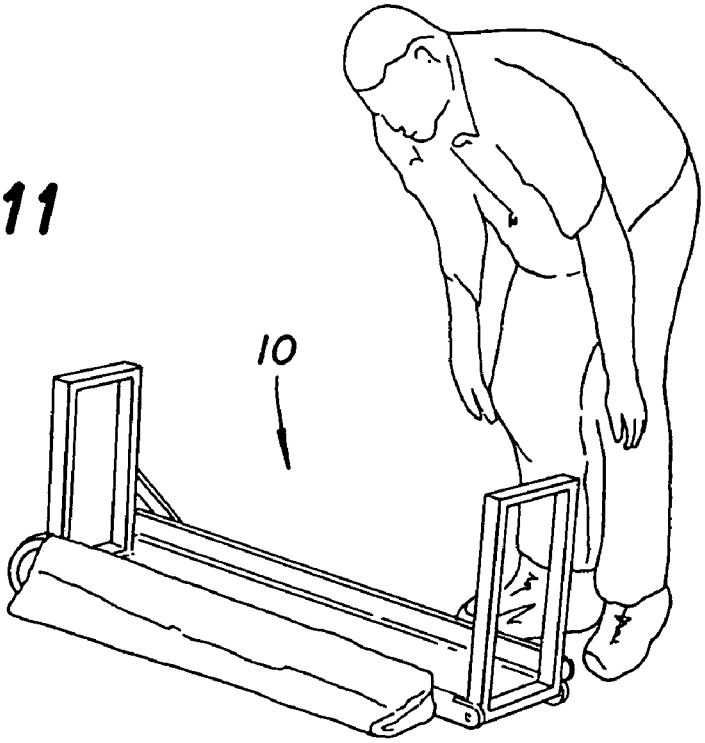
FIGS. 11–21 illustrate changing from a stowed condition to an extended condition of the illustrated preferred embodiment.
Figure 12:
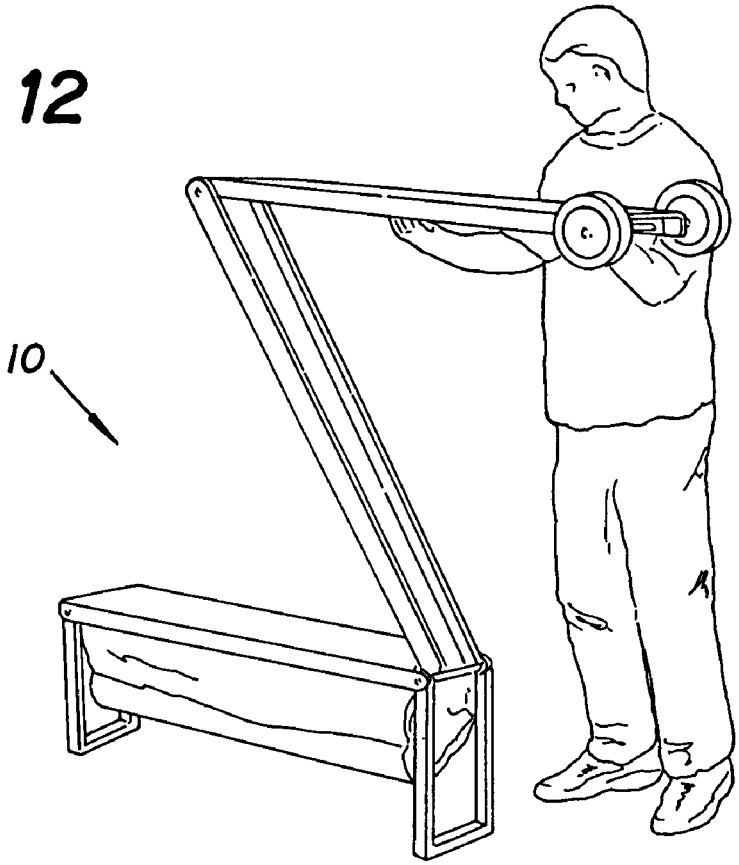
Figure 13:
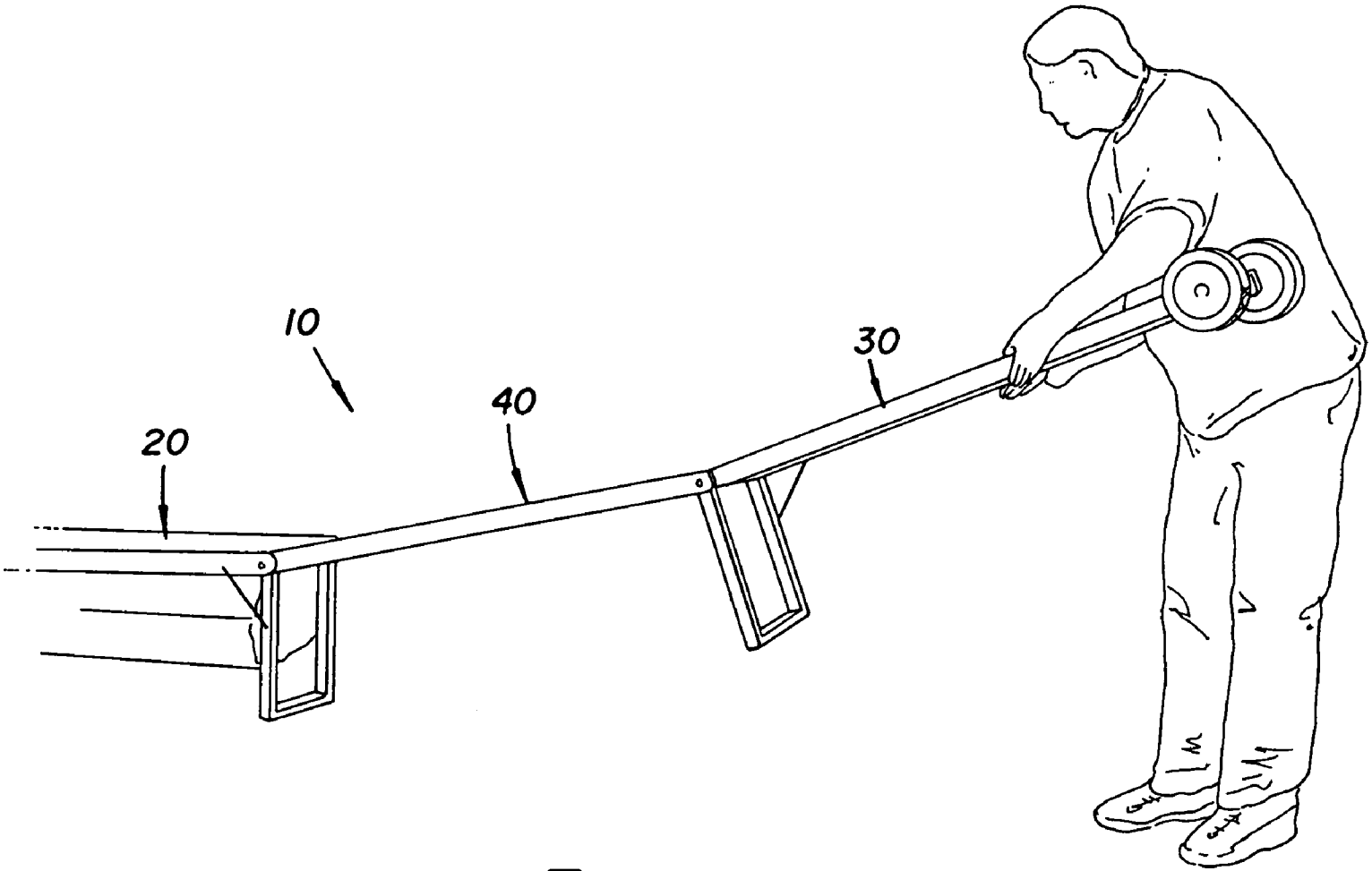
Figure 14:
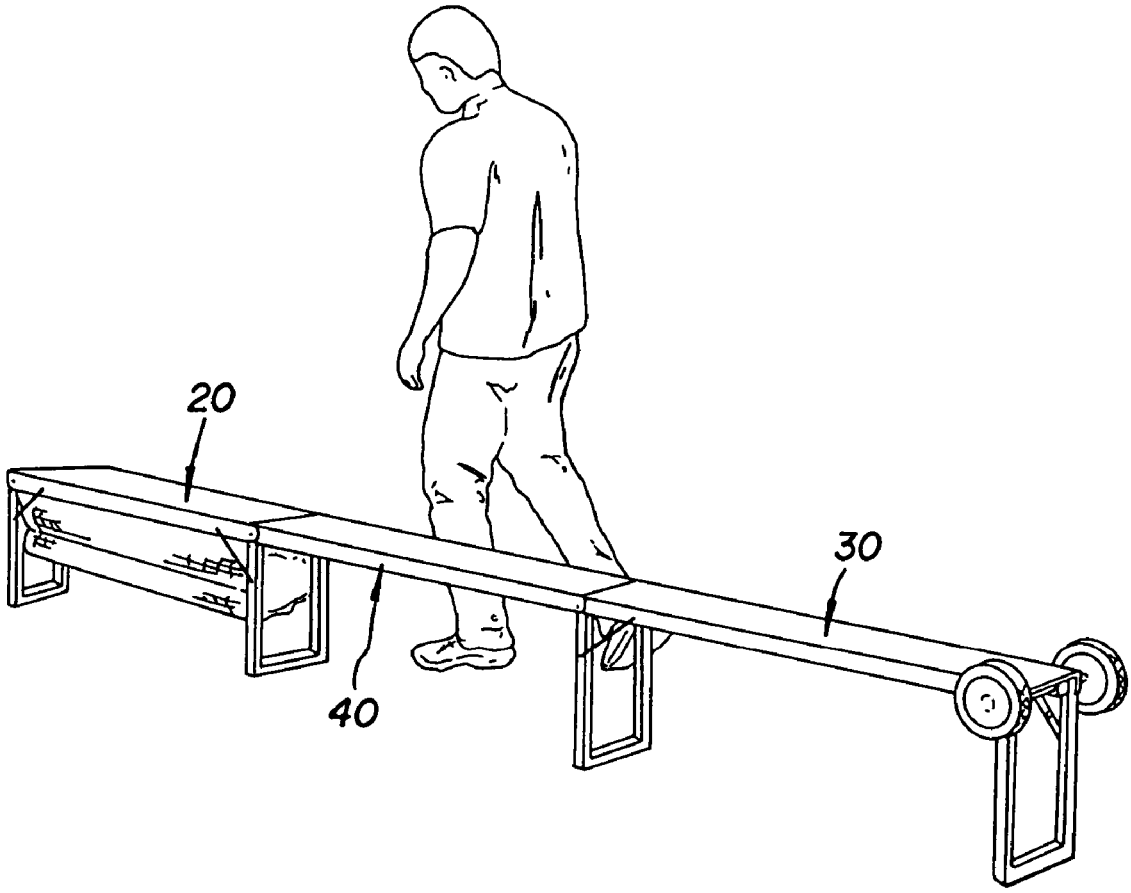
Figure 15:
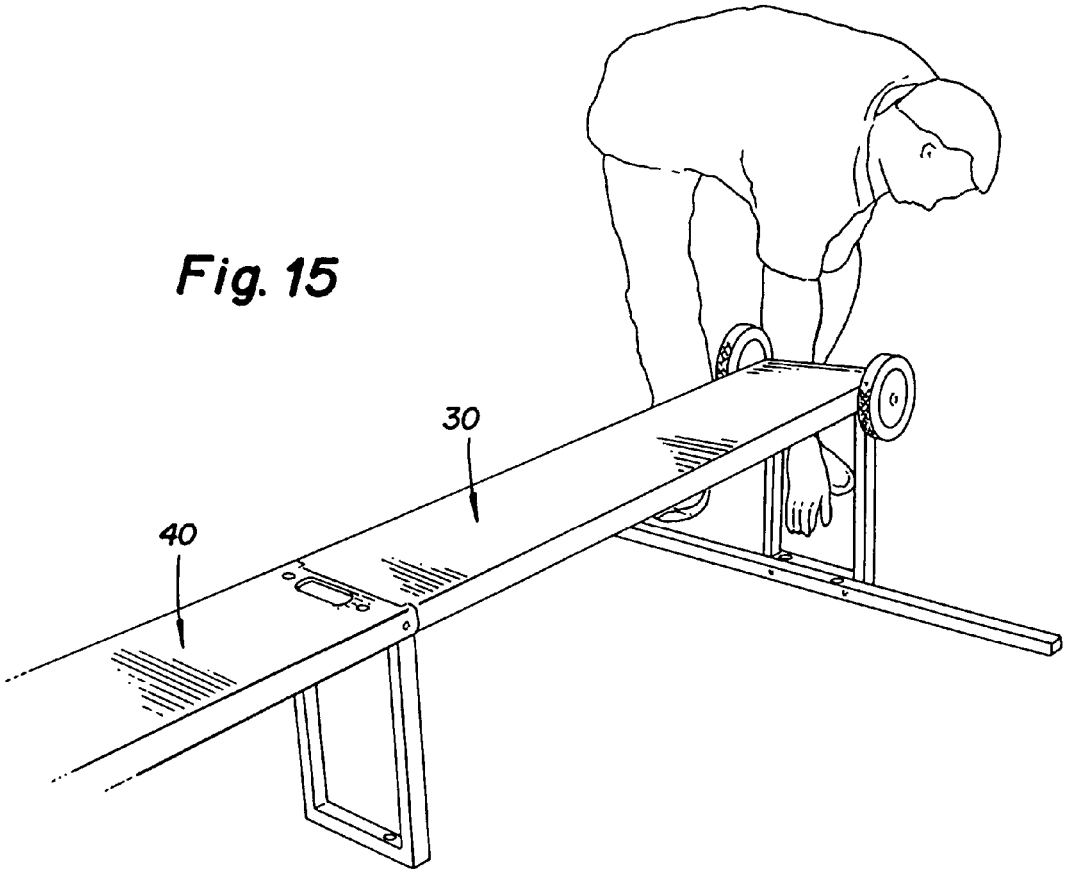
Figure 16:
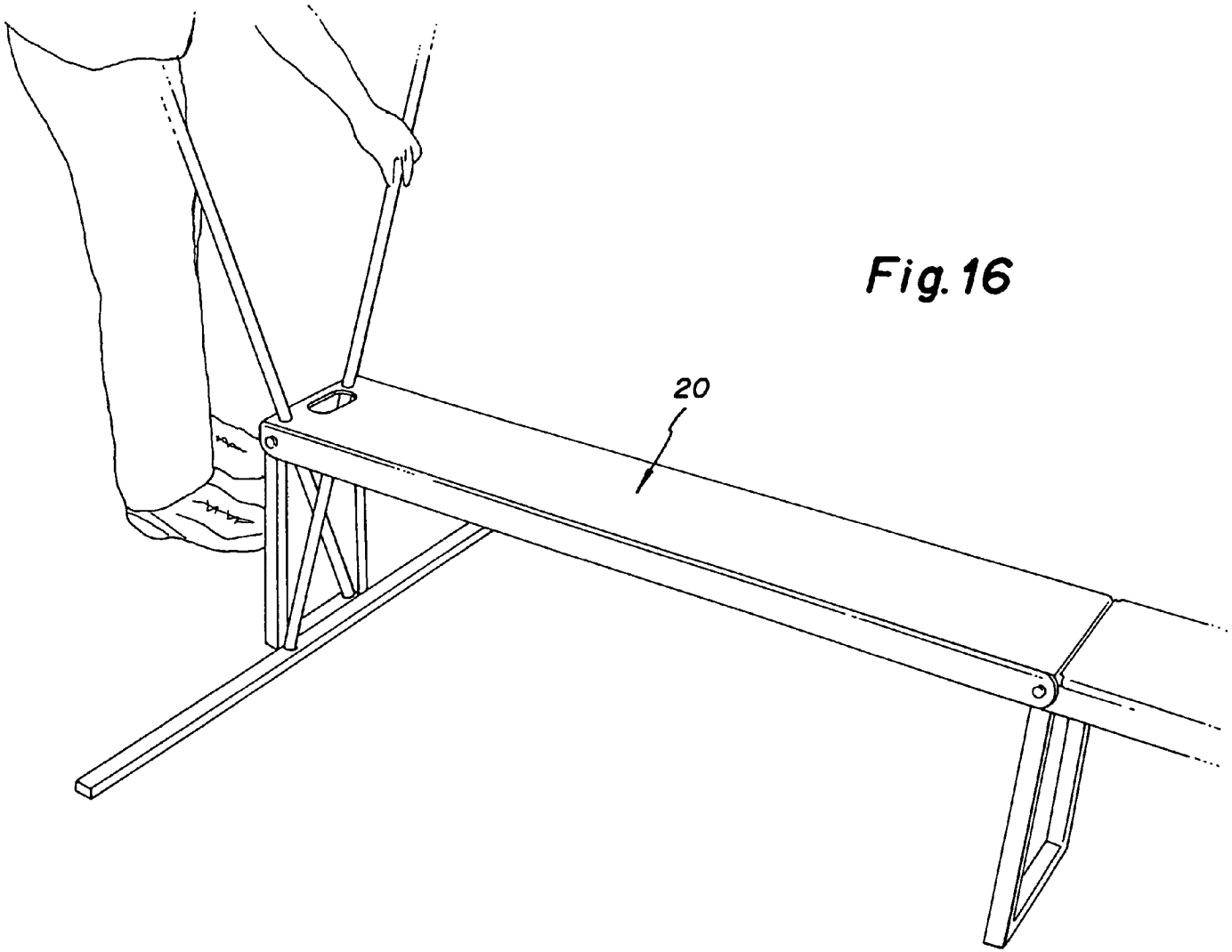
Figure 17:
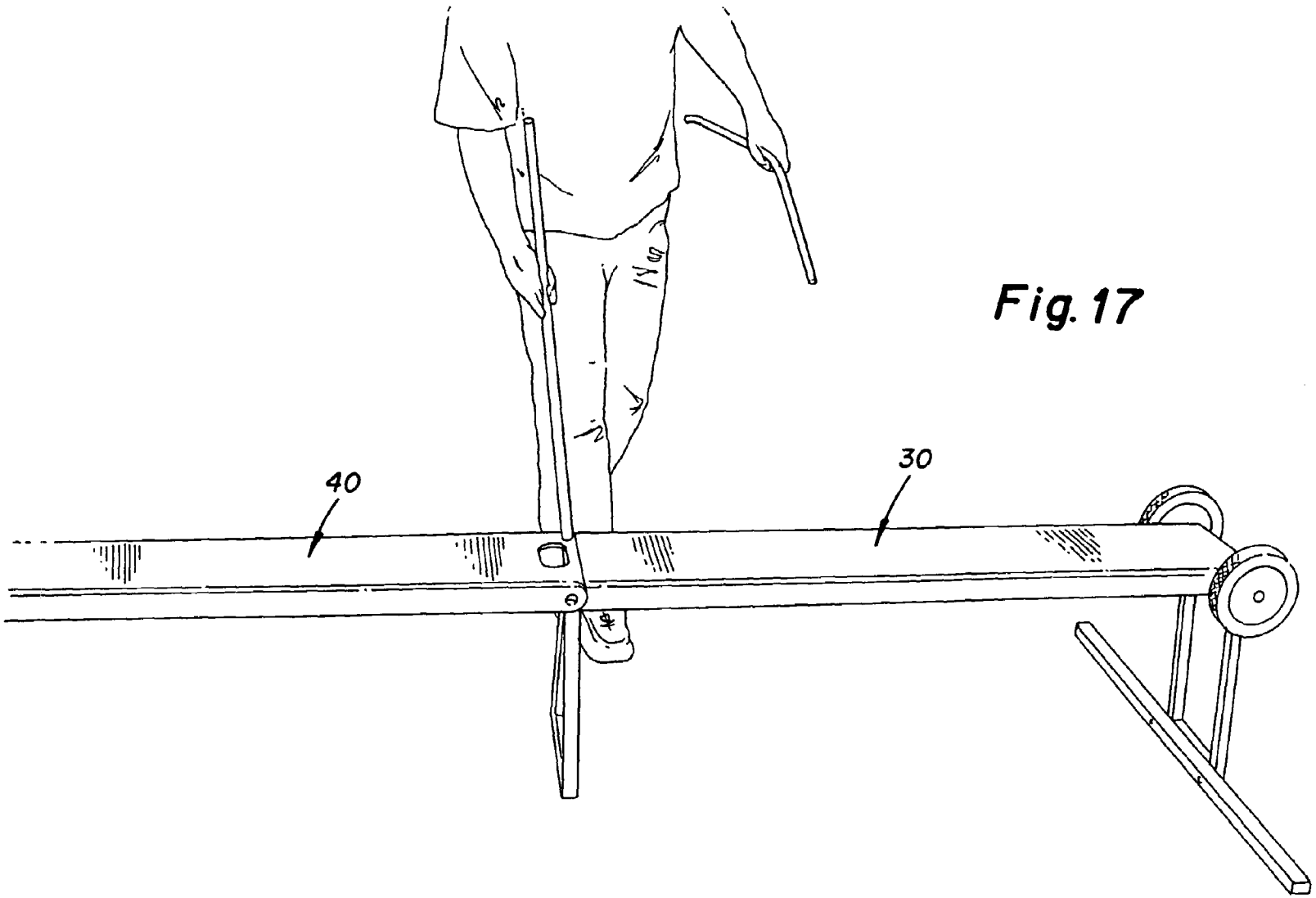
Figure 18:
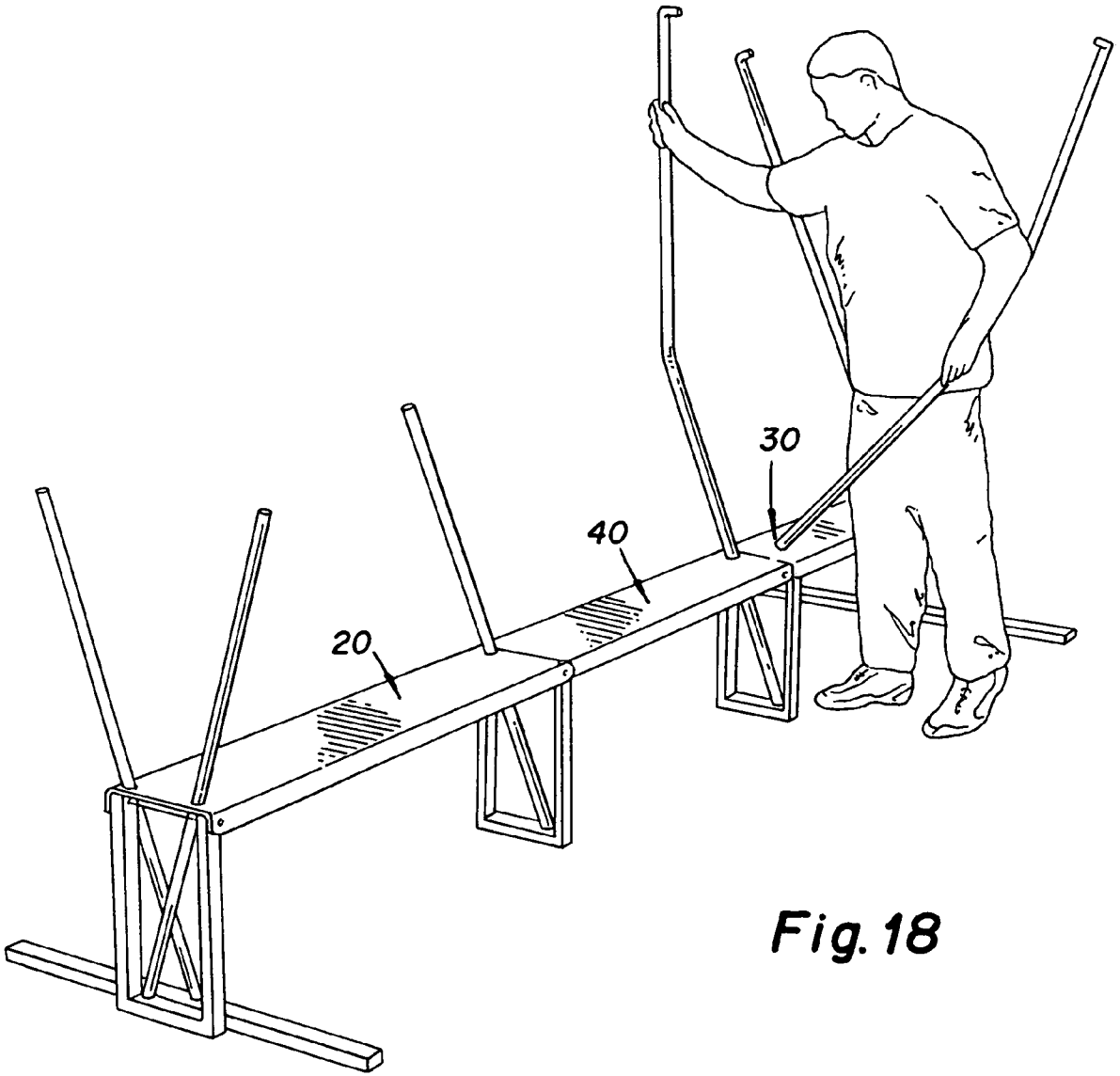
Figure 19:
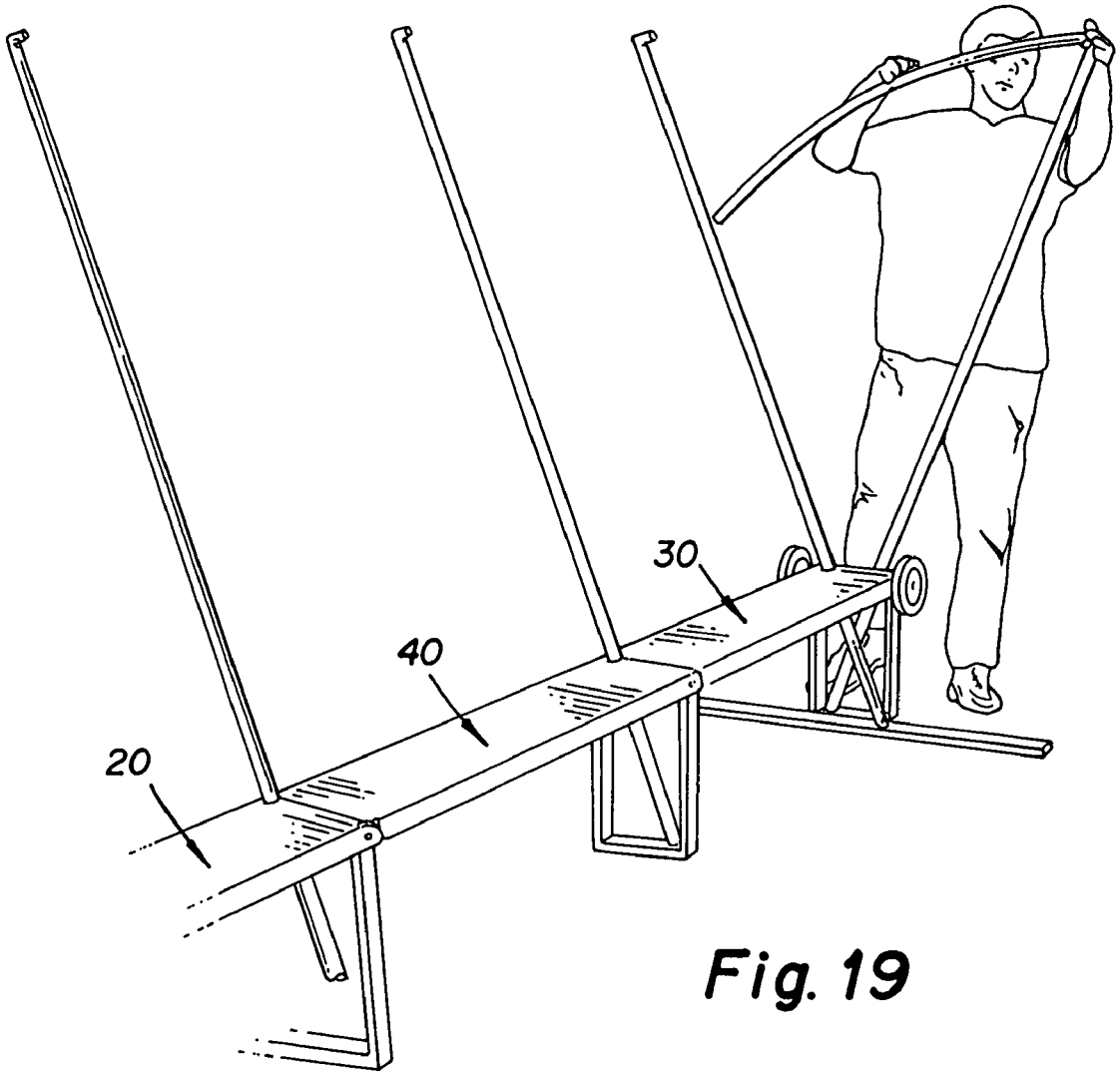
Figure 20:
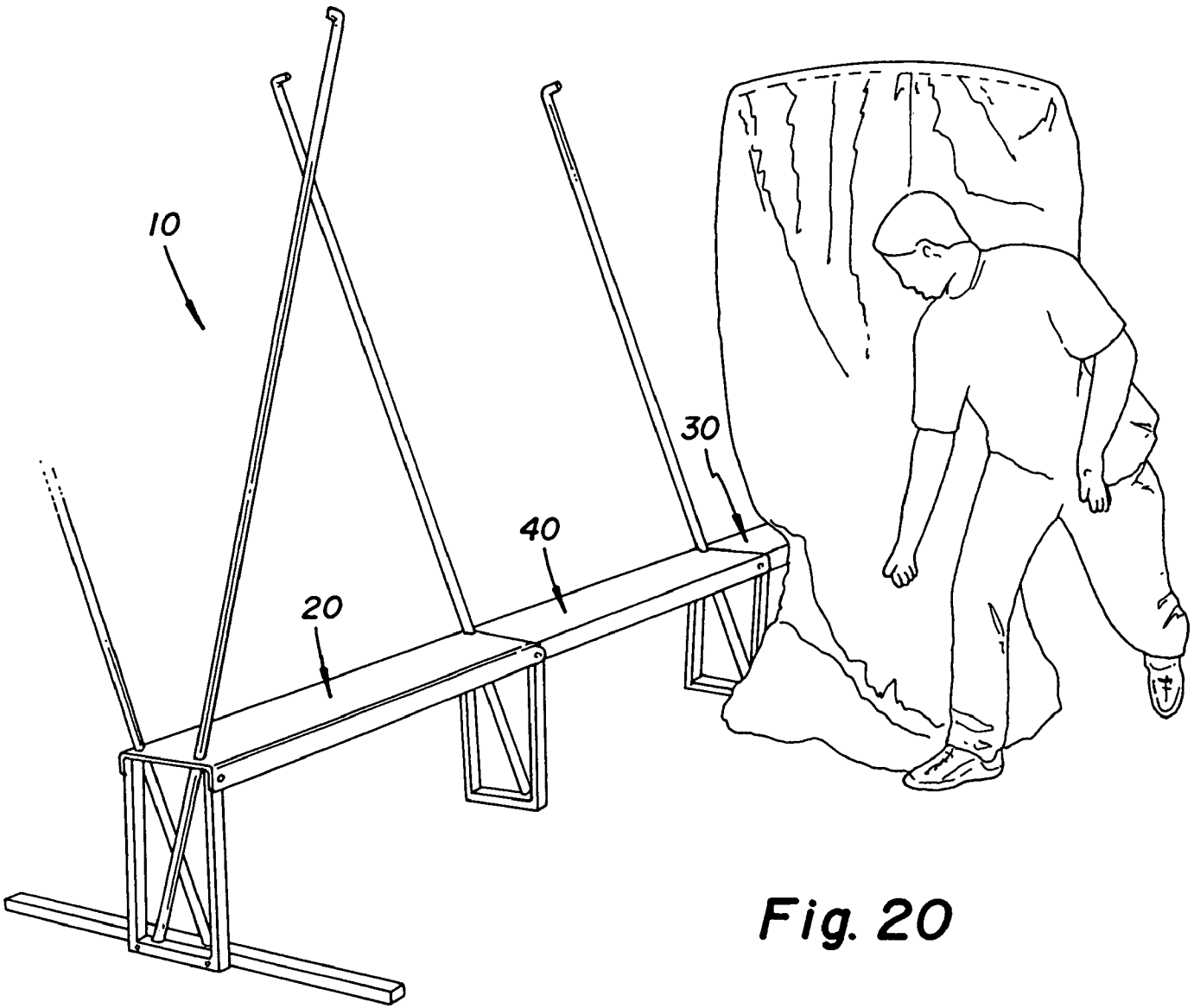
Figure 21:
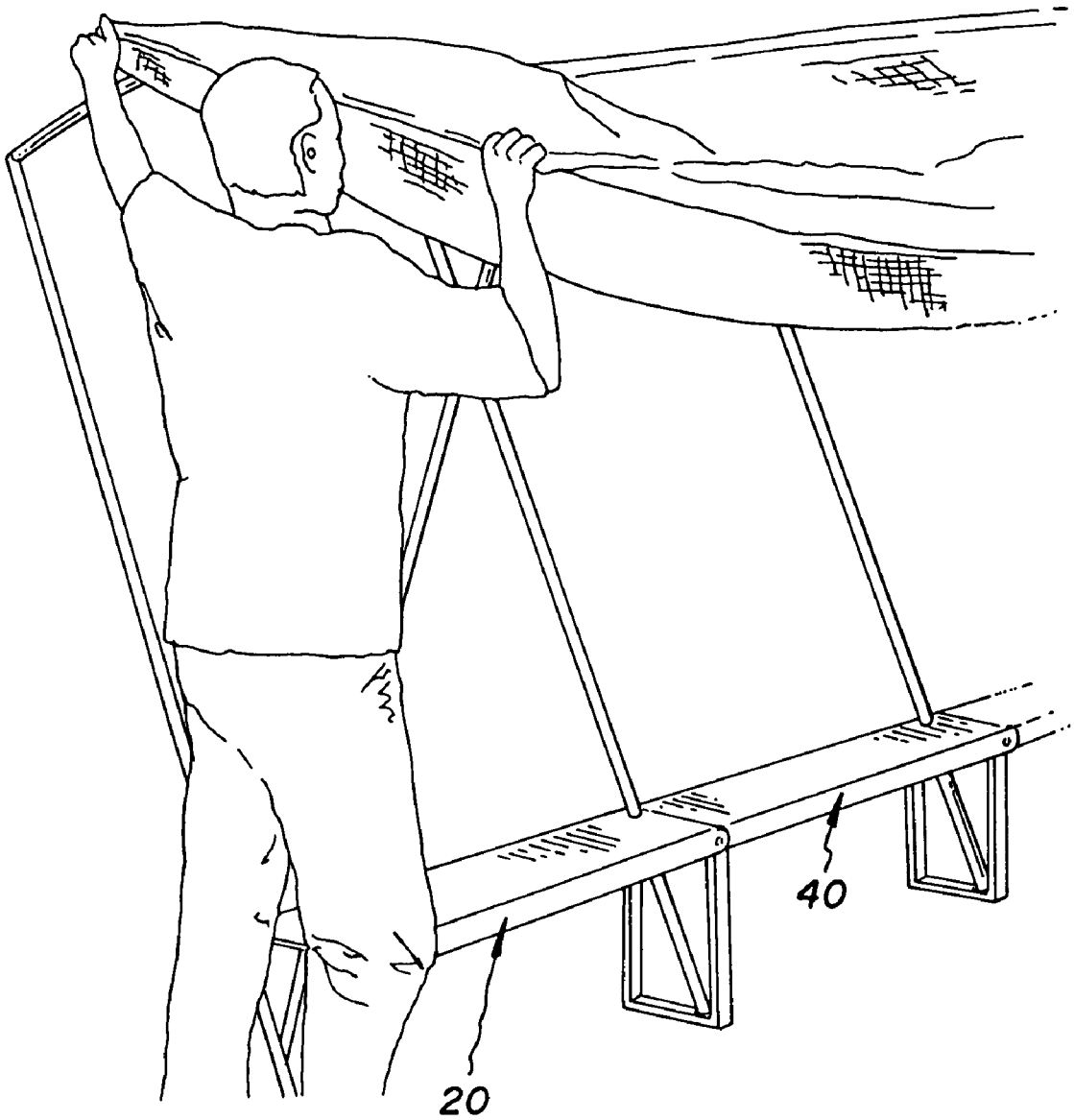
Figure 22:
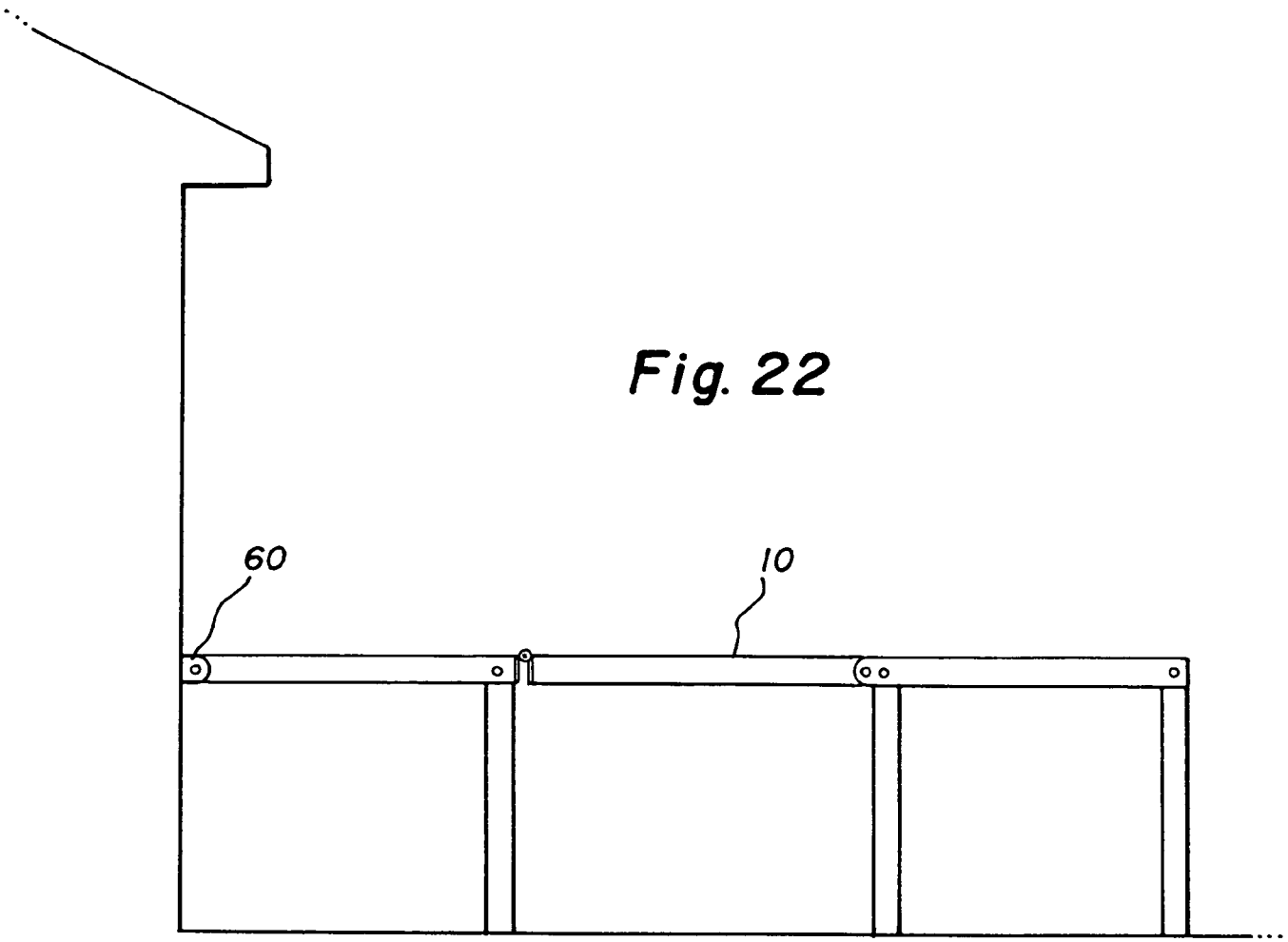
FIG. 22 illustrates a structure coupled to another fixed structure in accordance with the invention.

Referring to FIGS. 7–9, each of the seating platforms 20,30,40 can be substantially planar and composed of aluminum, plastic or composite materials to minimize weight. For example, the seating platforms 20, 30, 40 are extruded from aluminum, with longitudinal ribs (not illustrated) formed underneath the seating side for added strength and rigidity. In this regard, the longitudinal ends have downwardly extending lips L to add strength and rigidity. The lips L can be formed by bending a rectangular planar body about the longitudinal end portions 90° downwardly from the seating side. As illustrated, these seating platforms 20, 30, 40 are elongated or rectangular, but can have different geometric configuration, such as a curved configuration if desired.

The seating platforms 20, 30,40 are preferably articulated or hingedly connected together, such as by using a pivot or an axle through a common axis. In this regard, the articulated ends of the seating platforms 20, 30, 40 can have a conventional hinging mechanism, such as a pivot joint. In the exemplary embodiment, the hinging mechanism can include axles or rods inserted through axially aligned through holes 22, 32, 42 formed through both of the downwardly extending lips L and/or a bushing or the like 24, 44 formed between the lips L on of the articulated ends (right side of FIGS. 7B and 8B) of the first seating platform 20 and intermediate seating platform 40, and a pair of aligned ears 34 extending from the left ends of the lips L. The holes 22, 32, 42 formed in the articulated ends can be aligned and then an axle or rod or the like can be inserted through the holes. Appropriate stops or the like can be provided underneath the seating side of the either or both of the adjoining seating platforms, at the articulated ends to restrict downwardly pivoting movement when the seat is extended to the use position. The articulated ends of the intermediate and second seating platforms 40, 30 can also have the same hinge configuration described above.

Referring to FIGS. 2B and 2C, one end (right side) of the first (left) seating platform 20 is articulated to one end (left side) of the intermediate seating platform 40 and the other end (right side) of the intermediate seating platform 40 is articulated to one end (left side) of the second seating platform 30. The intermediate seating platform 40 is pivotable substantially about 180° relative to the first seating platform 20 in a first (clockwise) rotational direction from the stowed position to the extended position, and the second seating platform 30 is pivotable about 180° relative to the intermediate seating platform 40 in a second (counterclockwise) rotational direction from the stowed position to the extended position. The first and second rotational directions are always opposite to each other. The wheels W can be connected to the outer end (right side) of the second seating platform 30. Specifically, the wheels can be attached to an axle extending through the axially aligned holes 32 formed at the right end of the lips L of the second seating platform 30.

Referring to FIGS. 1, 3, 7A, and 8A, the seating structure can include a handle H, which can comprise a first elongated hole H1 (FIGS. 3, 7A) formed through left end side of the first seating platform 20 and a second elongated hole H2 (FIGS. 3, 8A) formed through the right end side of the intermediate seating platform 40. The first and second elongated holes H1, H2 are positioned adjacent to the outer end (left side) of the first seating platform 20 and adjacent to the articulated ends (right side) of the intermediate seating platform 40 and the second seating platform 30 so that when the seating platforms are folded to the stow position (FIG. 1), the first and second elongated holes H1, H2 align with each other form a handle configured for grasping.

Referring to FIGS. 2A–2C, 3, 4A, 10A, 10B, the supports S include first, second, third, and fourth supports S1, S2, S3, S4, which all can be identically configured and articulated to the seating platforms 20, 30, 40. Specifically, the first support S1 can be articulated or pivotally connected to the left end of the first seating platform 20, the second support S2 can be articulated or pivotally connected to the right end of the second seating platform 30, and the third and fourth supports S3, S4 can be articulated or pivotally connected to intermediate portions of the seating platforms between the first and second supports. Specifically, the third support S3 can be articulated to one of the articulated ends of the first seating platform 20 and the intermediate seating platform 40, and the fourth support S4 can be articulated to one of the articulated ends of the intermediate seating platform 40 and the second seating platform 30. The axis of rotation of the third and fourth supports S3, S4 can coincide with the articulating or pivoting axis of the respective seating platforms 20, 30, 40. Moreover, the wheel axis of rotation can coincide with the axis of rotation of the second support S2, i.e., they can share a common axle or pivot.

Referring to FIGS. 2A–2C, 3, 4A, and 4B, the supports S1, S2, S3, S4 are pivotally mounted to the respective seating platforms 20, 30, 40 as described above. The supports can be any weight or load bearing structure, such as legs, braces, angles, etc. Although each support can have any load supporting configuration, the illustrated exemplary embodiment (FIG. 10A, 10B) has a U-shape profile, with a substantially horizontally extending member SH that contacts the ground/floor for added stability and support.

Figure 4B:
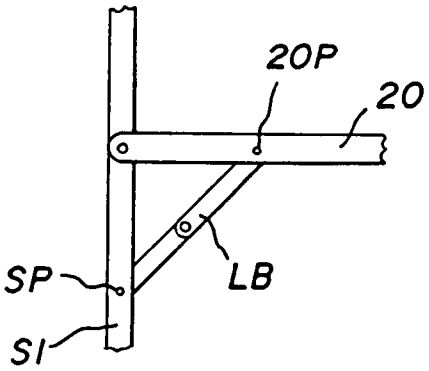
FIG. 4B illustrates an enlarged view of section 4B of FIG. 4A, illustrating a locking brace.
Figure 4A:
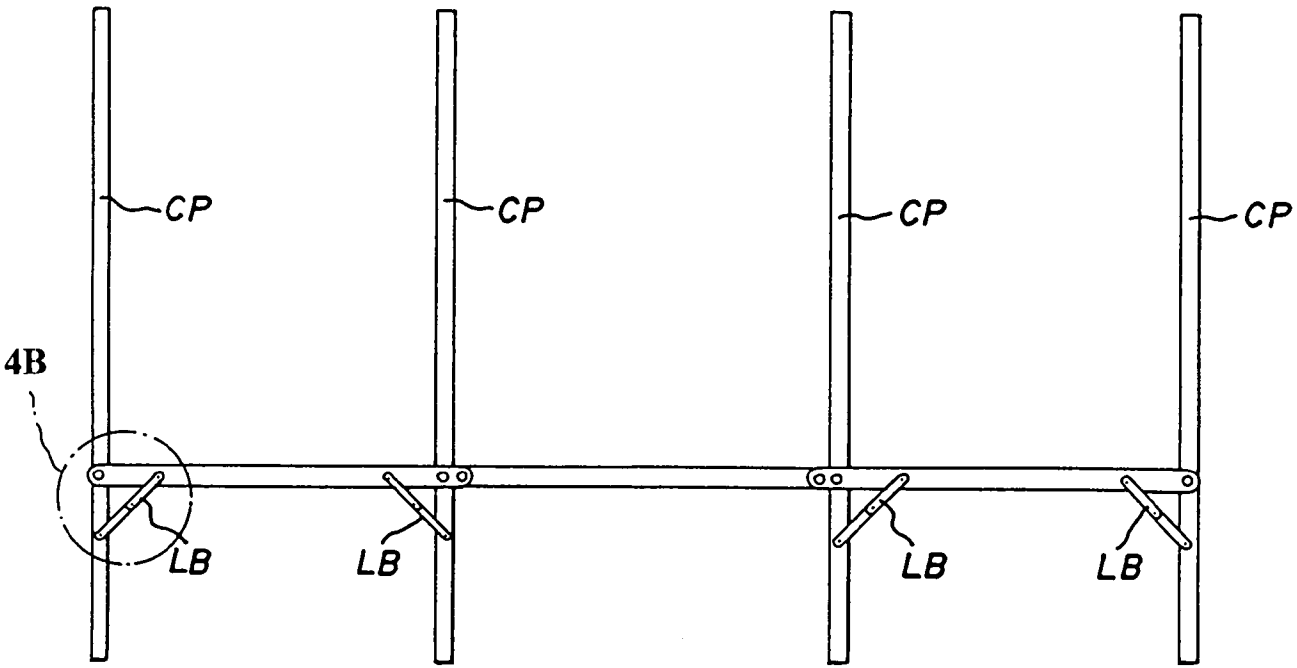
FIG. 4A illustrates a front view of the seating structure of FIG. 3, but with a canopy frame mounted in place.

Referring to FIGS. 4A and 4B, to lock the supports in the downwardly extending configuration (i.e., perpendicular to the seating platforms), at least one locking brace LB can be included for each support. The locking brace LB is conventional, typically used to maintain table legs locked to the use position. Specifically each locking brace is composed of two articulated arms. One end of the articulated arms is articulated to the support S at SP and the other end thereof is articulated to the respective lip L of the seating platform at 20P, 30P. The articulated arms typically include a stop to limit the articulated arms from pivoting beyond the desired locked position.

Further, to stabilize the supports S, i.e., to prevent the seating structure from tipping about a longitudinal axis, at least two stabilizing support braces B1, B2 can be detachably connected to the first and second supports S1, S2. They can be detachably connected, for instance, by using quick release mechanism, such as bolts threaded to holes SBH (two illustrated) formed through the horizontal member SH of the support S. Specifically, the support braces B1, B2 each can be comprised of elongated structure, such as a bar. In the illustrated embodiment, the supporting braces are each formed of a rectangular bar, which can be detachably attached to the horizontally extending member SH of the U-shaped supports S1, S2.

Referring to FIGS. 2A–2C, to unfold or setup the present seating structure from its stowed position, the seating structure can be laid against a flat surface, such as a ground or table, with the second seating platform (or the platform with the wheels) 30 facing down to more easily maneuver the support unfolding operation. In this position, the underside of the first seating platform 20 faces up. The first and third supports S1, S3 can be pivoted in the opposite direction toward the locked position (FIG. 2A). Once the supports S1, S3 have been extended and locked into position using the locking braces LB (not shown in FIGS. 2A–2C), the seating structure can be flipped over so that the first and third supports S1, S3 contact the ground/table (FIG. 2B). Now lifting the second seating platform (the one with the wheels W) 30 upwardly will pivot or rotate the intermediate seating platform 40 clockwise as indicated by an arrow CW and the second seating platform 30 counterclockwise as indicated by an arrow CCW. In the position illustrated in FIG. 2B, now pulling the second seating platform 30 to the right, while maintaining the first seating platform 20 in place will further rotate the intermediate seating platform 40 in the clockwise direction, as well as rotating the second seating platform 30 in the counterclockwise direction until the second and third seating platforms each have rotated about 180° relative to the immediately adjoining seating platform 20, 40 to the position illustrated in FIG. 2C. The second and fourth supports S2, S4 can be unfolded or opened anytime during the unfolding stages, or can be opened after the seating platforms 40, 30 have been extended coextensively or collinearly as shown in FIG. 2C. Once the stabilizing braces B1, B2 are attached to the first and second supports S1, S2, the seating structure is ready for use.

The present seating structure can be used with or without a protective canopy for protection from the element, namely rain, snow, sun, and wind. The seating structure can include a removably mountable canopy frame CF and a canopy C. Referring to FIGS. 4A–6, any conventional canopy structure can be mounted to the present seating structure. In the exemplary embodiment, the canopy frame can comprise a plurality of poles CP, each of which can be foldable (i.e., more than one piece), and a plurality of cross bracing poles CCP. For instance, each pole CP, CCP can be formed of two or more pieces connected together. In the present configuration, six poles CP (CP1, CP2, CP3, CP4) and four cross bracing poles CCP can be used for the illustrated embodiment.

Referring to FIGS. 7–9, the canopy frame mount is quite simple. It uses holes formed in the seating platforms 20, 30, 40, the supports S1, S2, S3, S4, and the stabilizing braces B1, B2 to detachably mount the canopy frame. The left end of the first seating platform 20 and the right end of the second seating platform 30 each can have a pair (front and rear) of throughholes CH sufficiently sized as to pass the pair of first and second canopy poles CP1, CP2 at an angle. Between the pairs of canopy poles formed at the ends of the seating platforms, a third rear canopy pole CP3 is mounted to one of the articulated ends of the first seating platform 20 and the intermediate seating platform 40, and a fourth rear canopy pole CP4 is mounted to the one of the articulated ends of the second seating platform 30 and the intermediate seating platform 40. Specifically, the right ends of the first seating platform 20 and the intermediate seating platform 40 each have a rear throughhole CH (FIGS. 7A, 8A) aligned with the rear throughholes formed in the first and second seating platforms 20, 30. The third and fourth rear canopy poles CP3, CP4 are inserted through the respective rear throughholes CH.

Figure 5:
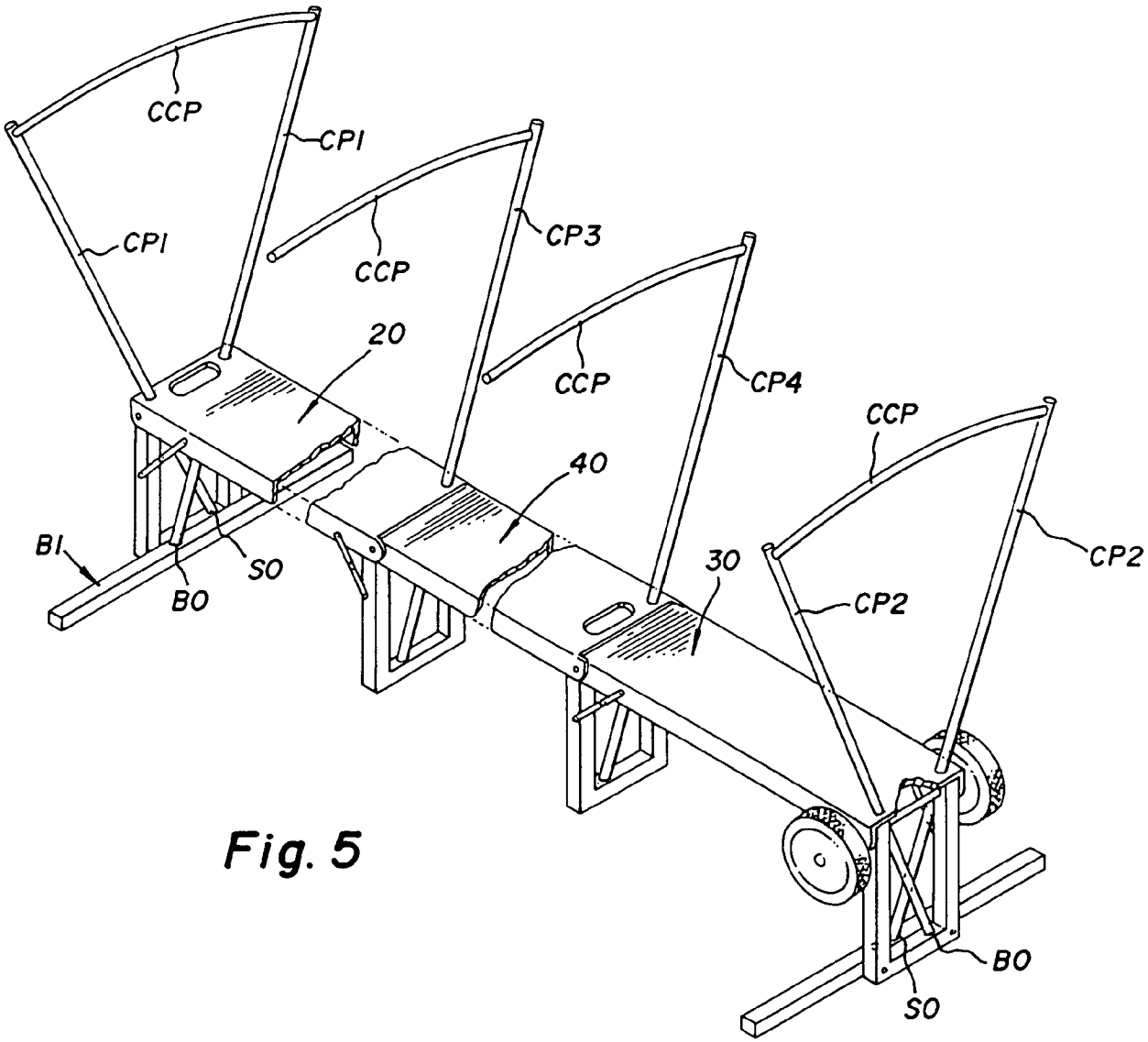
FIG. 5 illustrates a perspective view of the seating structure of FIG. 4A.
Figure 6:
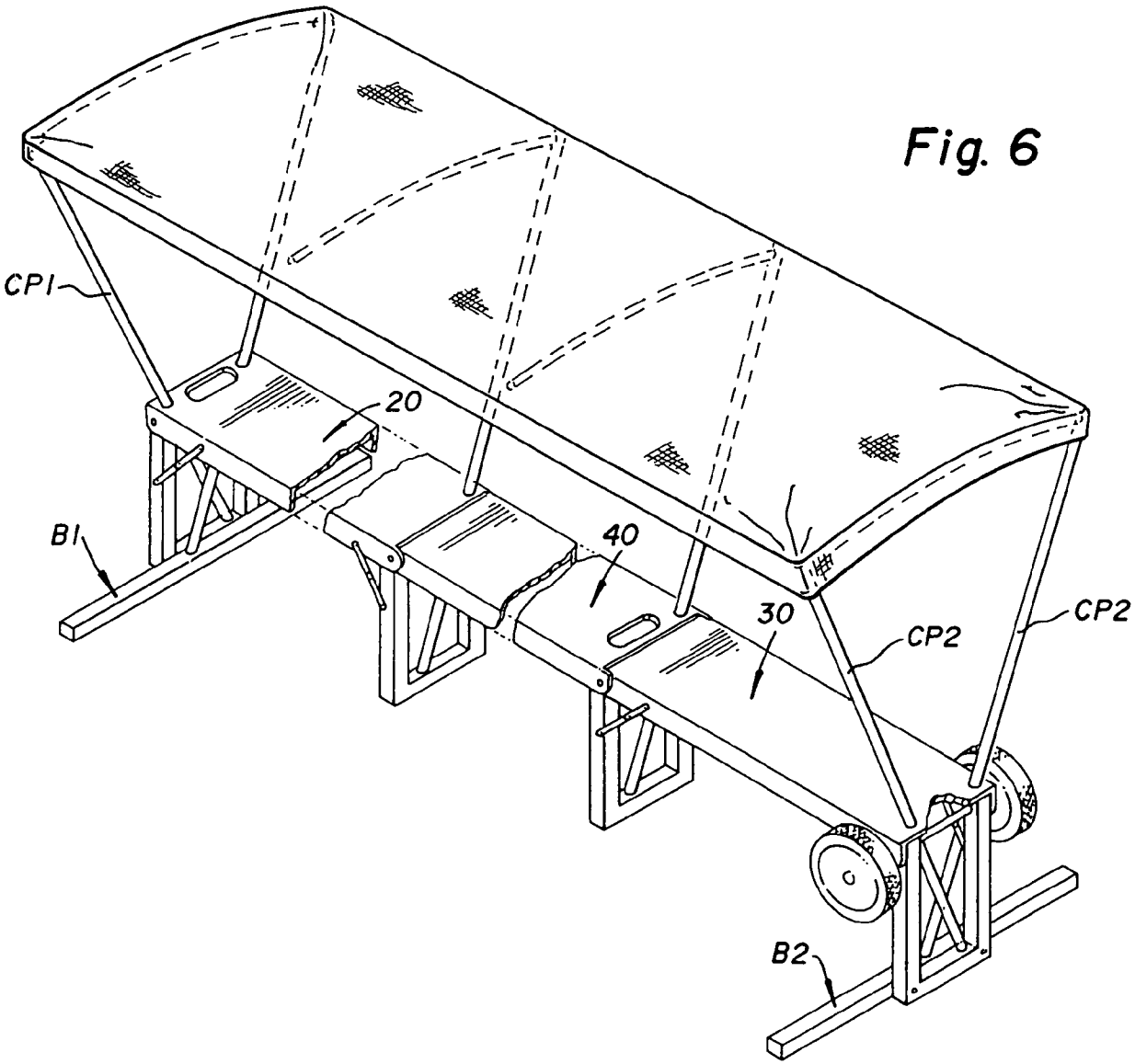
FIG. 6 illustrates the seating structure of FIG. 5, but with a canopy attached to the canopy frame.

The horizontal member SH of the first and second U-shaped supports S1, S2 each have an opening SO to receive the end portion of the rear canopy pole CP1, CP2. Similarly, the horizontal member SH of the third and fourth U-shaped supports S3, S4 each have an opening SO to receive the end portion of the rear canopy poles CP3, CP4. The rear canopy poles CP1, CP2, CP3, CP4 are situated an angle to position the canopy away from the upper torso and head. The front canopy poles CP1, CP2 are threaded through the respective front throughholes CH and into an opening BO formed in the first and second support brace B1, B2. The third and fourth canopy poles CP3, CP4 are substantially configured like the first and second rear canopy poles CP1, CP2. As illustrated in FIG. 5, the pair of canopy poles CP1, CP2 cross each other below the first and second seating platform 20, 30. In this regard, the crossing poles can have an offset configuration if desired.

A first cross canopy pole CCP1 is detachably connected to the front and rear canopy poles CP1, a second cross canopy pole CCP2 is similarly detachably connected to the front and rear canopy poles CP2. Third and fourth cross canopy poles CCP3, CCP4 are attached to the third and fourth canopy poles CP3, CP4, respectively, but are suspended at the other ends. The third and fourth cross canopy poles can be threaded through sleeves formed in the canopy. The cross canopy poles can be arched or bent, as illustrated in FIG. 5. The canopy can be attached to the canopy frame in any conventional manner, such as with a velcro, straps, sleeves, or any combination thereof.

For improved protection from the element, the front part of the canopy can be draped over to the ground. The draped portion can be made of see-through material, such as a nylon mesh, vinyl, plastic, etc. The present seating structure can be instantly converted to a hunting blind by using appropriate canopy design/configuration, such as a camouflage pattern, with appropriate openings for viewing and extending barrels of firearms through the canopy.

To store the canopy frame and the support braces, at least one storage compartment 50 can be detachably mounted to the supports. For instance, a bag sized to hold the canopy frame or support braces or both can be detachably mounted to the front or rear side of the first and third supports S1, S3, such as with velcro connections. Similarly, the canopy itself can be wrapped around or tucked inside the folded seating platforms. Alternately, the canopy can be stored in a separate storage compartment and mounted to the rear side of the first and third supports.

The actual set up of the illustrated embodiment from the stowed position to the extended position is illustrated by FIGS. 11–21. These figures describe the steps discussed above. It is also noted that, in the illustrated preferred embodiment, the canopy and the poles used to support the canopy can be stored in a bag that is attached to the structure 10 by a hook and loop fastener or similar method, thereby providing one completely integrated unit.

Figure 23:
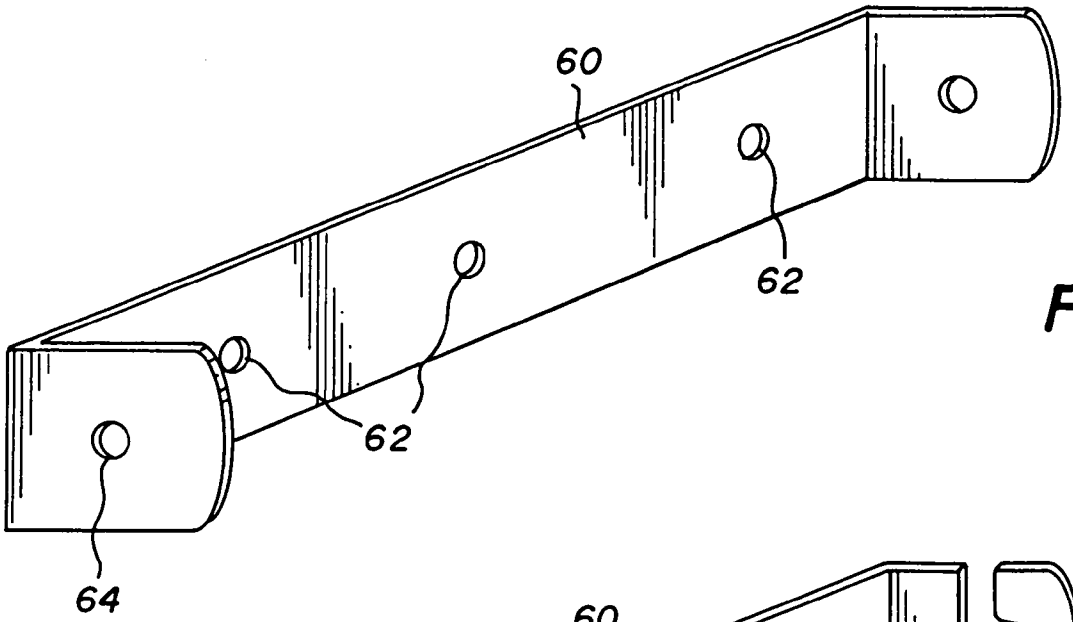
FIG. 23 illustrates a first embodiment of a mounting structure.
Figure 25:
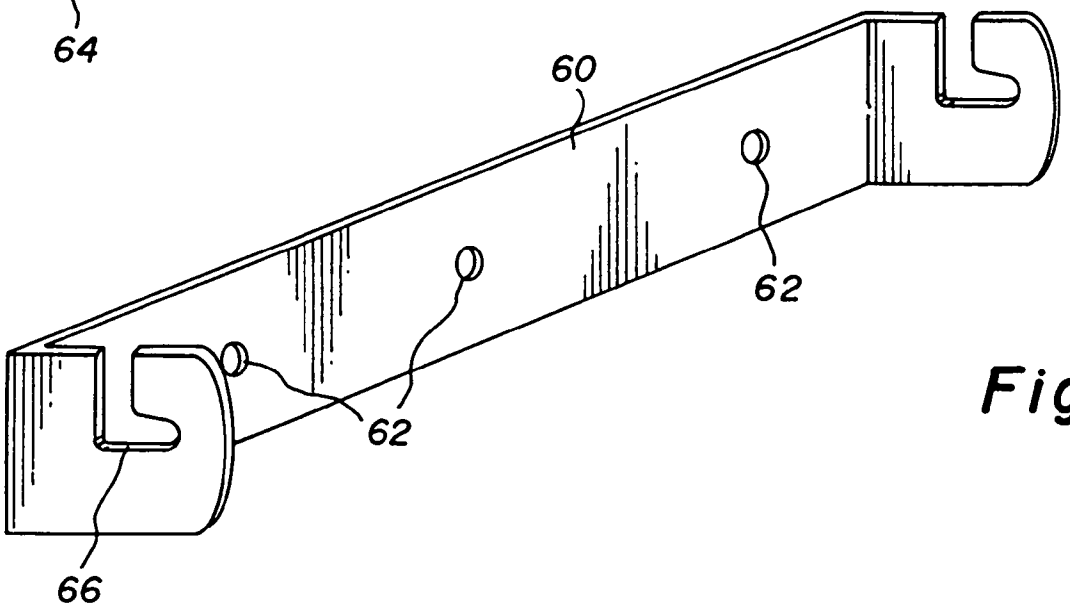
FIG. 25 illustrates a second embodiment of a mounting structure.
Figure 24:
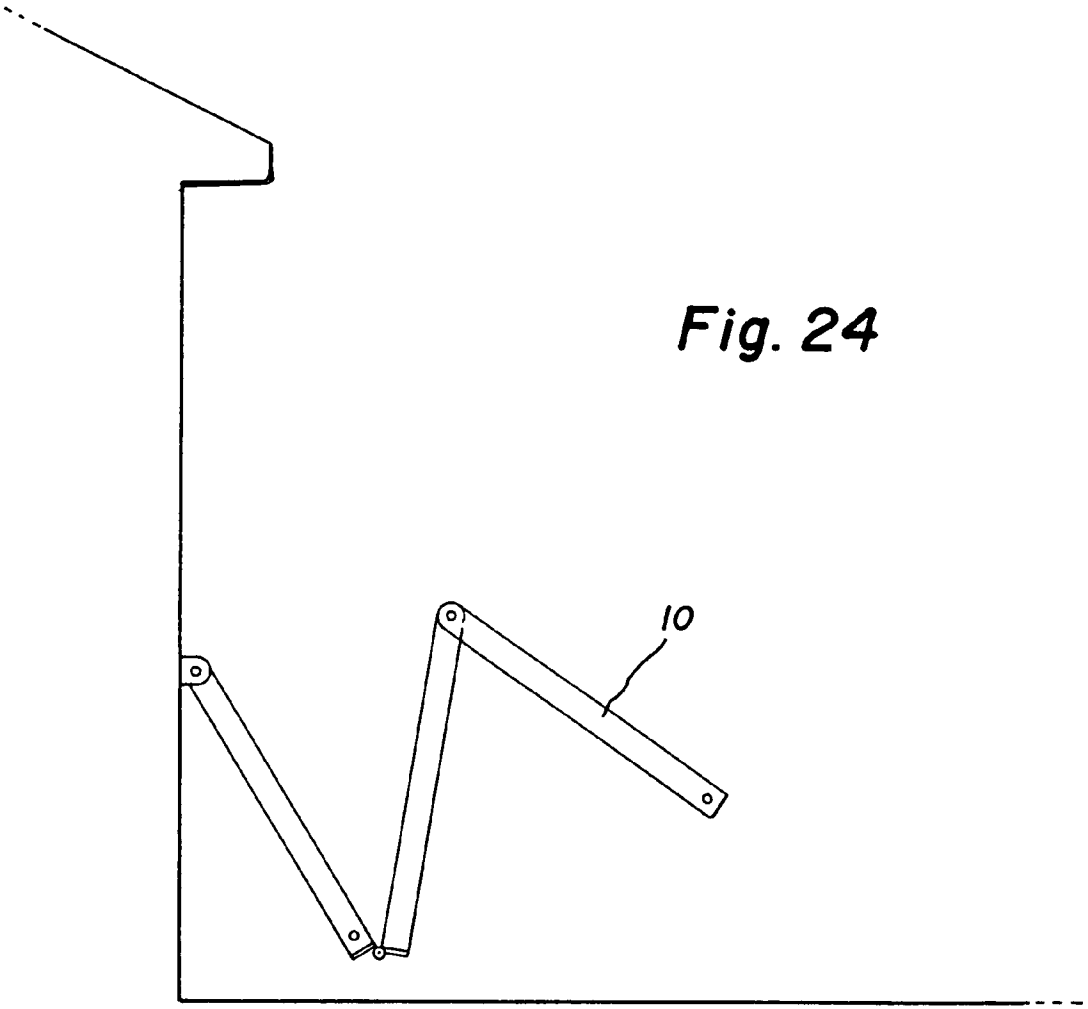
FIG. 24 illustrates the structure of FIG. 22 in a partially folded position.

Given the disclosure of the present invention, one versed in the art would appreciate that there may be other embodiments and modifications within the scope and spirit of the present invention. For example, FIGS. 22–25 illustrate a further embodiment of the invention in which a mounting mechanism is provided to permit the structure 10 to be mounted to another structure. In the example illustrated in FIG. 22, the structure 10 is mounted to a house by a mounting mechanism 60. The mounting mechanism 60 can be of a type that substantially fixes the structure 10 to the other structure or can be of a type that allows the structure 10 to be temporarily fixed and easily removed when not in use. If substantially fixed, as shown in the illustrated embodiment, the supports closest to the mounting point can be removed from the structure 10 if desired. FIG. 23 illustrates an example of a mounting structure 60 that includes mounting holes 62 and pivot holes 64. Bolts (not shown) are provided that pass through the mounting holes 62 to anchor the structure 10 to the house. The structure 10 is pivotally mounted via a fitting, for example a bolt or pin (not shown), that passes through the pivot holes 64, thereby substantially fixing the structure 10 to the mounting structure 60 while still allowing the structure 10 to pivot and fold against the house as shown in FIG. 24. FIG. 25 illustrates another example of a mounting structure 66. In this embodiment, the pivot holes 64 are replaced by pivot slots 66 that capture fasteners, for example a bolt or pin (not shown), provided on the structure 10. The use of the pivot slots 66 permits the structure 10 to be removeably attached to the house, as the capture fasteners can slide out of the pivot slots 66.

Still further modifications and variations are possible within the scope of the appended claims. For example, the mounting mechanism may be modified to couple the structure 10 to any other type of structure including a vehicle. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. A portable platform structure comprising:

at least two articulated platforms, the platforms being articulated so that the platforms are movable between an extended position where the platforms extend substantially in an end-to-end configuration, and a stow position where the platforms are folded so that the platforms are substantially aligned one above another; and a plurality of supports articulated to the platforms;

wherein the platforms are articulated for a pivotal movement about 180°, and wherein the platforms comprise a first end platform, at least one intermediate platform, and a second end platform, one end of the first end platform being articulated to one end of the intermediate platform, and the other end of the intermediate platform being articulated to one end of the second end platform, the intermediate platform being pivotable 180° relative to the first end platform in a first rotational direction from the stowed position to the extended position, and the second end platform being pivotable 180° relative to the intermediate platform in a second rotational direction from the stowed position to the extended position, the second rotational direction being opposite to the first rotational direction, and wherein a pair of wheels are rotatably mounted to the other end of the second end platform, and wherein the supports include a first support foldably articulated to an outer end portion of the first end platform, a second support foldably articulated to an outer end portion of the second end platform, and third and fourth supports foldably articulated to intermediate portions of the platforms between the first and second supports, and wherein the first support is pivotable substantially about 90° relative to the other end of the first end platform, the third support is pivotable substantially about 90° relative to one of the articulated ends of the first end platform and the intermediate platform, the fourth support is pivotable substantially about 90° relative to one of the articulated ends of the intermediate platform and the second end platform, and the second support is pivotable substantially about 90° relative to the other end of the second end platform, further including a canopy frame detachably mountable to the platforms and the first, second, third, and fourth supports, and a canopy detachably mountable to the canopy frame.

2. A portable platform structure according to claim 1, wherein the canopy frame comprises a pair of first poles detachably mountable to the first end platform; a pair of second poles detachably mountable to the second end platform, a third pole detachably mountable to one of the first end platform and the intermediate platform, and a fourth pole detachably mountable to one of the second end platform and the intermediate platform.

3. A portable platform structure according to claim 2, wherein the other end of each of the first and second end platforms has a pair of holes for passage of the respective pair of first and second poles, and the one end of the first end platform has an opening for passage of the third pole, and the other end of the intermediate platform has an opening for passage of the fourth pole.

4. A portable platform structure according to claim 3, wherein the first, second, third, and fourth supports each have an opening for receiving one of the pairs of first and second poles or one of the third and fourth poles, respectively.

5. A portable platform structure according to claim 4, further including a first elongated support brace detachably mountable to the first support and a second elongated support brace detachably mountable to the second support to stabilize the structure from tipping.

6. A portable platform structure according to claim 5, wherein the first and second support braces each have an opening for receiving one of the pair of first and second poles, respectively.

7. A portable platform structure according to claim 6, wherein the canopy has a camouflage pattern.

8. A portable platform structure according to claim 5, further including at least one storage compartment detachably mountable to one side of the first and third supports, wherein the storage compartment is configured to store at least one of the canopy frame and the support braces.

* * * * *